US008756954B2

(12) United States Patent
Tsukamoto et al.

(10) Patent No.: US 8,756,954 B2
(45) Date of Patent: Jun. 24, 2014

(54) TURBO COMPRESSOR AND TURBO REFRIGERATOR

(75) Inventors: Minoru Tsukamoto, Yokohama (JP); Kentarou Oda, Yokohama (JP)

(73) Assignee: IHI Corporation (JP)

( * ) Notice: Subject to any disclaimer, the term of this patent is extended or adjusted under 35 U.S.C. 154(b) by 946 days.

(21) Appl. No.: 12/365,989

(22) Filed: Feb. 5, 2009

(65) Prior Publication Data

US 2009/0193842 A1 Aug. 6, 2009

(30) Foreign Application Priority Data

Feb. 6, 2008 (JP) ..... P2008-027068

(51) Int. Cl.
*F25B 1/10* (2006.01)

(52) U.S. Cl.
USPC ..... 62/510; 62/500; 62/116

(58) Field of Classification Search
USPC ..... 62/116, 469, 500, 510
See application file for complete search history.

(56) References Cited

U.S. PATENT DOCUMENTS

| | | | | |
|---|---|---|---|---|
| 2,903,182 | A | 9/1959 | Downs et al. | |
| 2007/0147985 | A1 * | 6/2007 | Takahashi et al. | 415/104 |

FOREIGN PATENT DOCUMENTS

| | | |
|---|---|---|
| CN | 1432415 | 7/2003 |
| EP | 1 318 307 | 6/2003 |
| GB | 920188 | 3/1963 |
| JP | 5-223090 | 8/1993 |
| JP | 11-230098 | 8/1999 |
| JP | 2003-269394 | 9/2003 |
| JP | 2006-194579 | 7/2006 |
| JP | 2007-177695 | 7/2007 |

OTHER PUBLICATIONS

Chinese Office Action issued Jul. 9, 2010 in connection with corresponding Chinese Patent Application No. 200910003830.9 with English Language Translation.

Office Action dated Feb. 29, 2009 issued in corresponding Chinese Patent Application No. 200910003830.9 with English translation (13 pages).

Office Action dated Feb. 29, 2012 issued in corresponding Chinese Patent Application No. 200910003830.9 with English translation (13 pages).

Japanese Office Action, dated Jun. 19, 2012, issued in corresponding Japanese Patent Application No. 2008-027068. English translation included. Total 6 pages.

* cited by examiner

*Primary Examiner* — Cassey D Bauer
(74) *Attorney, Agent, or Firm* — Ostrolenk Faber LLP

(57) ABSTRACT

A turbo compressor is provided with a first compression stage that draws in and compresses a fluid, and a second compression stage connected to the first compression stage via a rotation shaft, that further compresses the compressed fluid from the first compression stage. The first compression stage and the second compression stage are arranged adjacent to each other with their backsides facing each other. A discharge port of the first compression stage, and a suction port of the second compression stage are formed in the same plane, and there is provided a U-shaped pipe that connects the first discharge port and the second suction port.

5 Claims, 4 Drawing Sheets

TURBO COMPRESSOR AND TURBO REFRIGERATOR

BACKGROUND OF THE INVENTION

1. Field of the Invention

The present invention relates to a turbo compressor, and more specifically relates to a two-stage turbo compressor, in which two impellers are fixed in a direction with their backsides facing each other on the same rotation axis.

Priority is claimed on Japanese Patent Application No. 2008-27068, filed Feb. 6, 2008, the content of which is incorporated herein by reference.

2. Description of Related Art

As a refrigerator that cools or refrigerates an object to be cooled such as water, there is known a turbo refrigerator furnished with a turbo compressor that compresses a refrigerant by a compression stage provided with an impeller or the like, and discharges the refrigerant.

In the compressor, when the compression ratio increases, the discharge temperature of the compressor rises and volumetric efficiency drops. Therefore, in some cases, in the turbo compressor provided in the turbo refrigerator, compression of the refrigerant is performed in a plurality of stages.

For example, in Japanese Unexamined Patent Application, First Publication No. Hei 5-223090 there is disclosed a two-stage turbo compressor that has compression blades (impellers) at opposite ends of a drive motor shaft, and a fluid compressed by a first impeller is delivered to a second impeller.

In this turbo compressor, the fluid compressed by the first impeller is guided to a suction port of the second impeller via piping provided outside (external piping).

Moreover, in Japanese Unexamined Patent Application, First Publication No. 2007-177695 there is disclosed a turbo compressor in which two impellers are arranged adjacent to each other with their backsides facing each other.

In this turbo compressor, piping (internal piping) for introducing fluid compressed by a first impeller to a second impeller, is formed in a first housing enclosing the first impeller and a second housing enclosing the second impeller.

In the conventional turbo compressors described above, there are the following problems.

That is to say, the turbo compressor disclosed in Japanese Unexamined Patent Application, First Publication No. Hei 5-223090, is one where a drive motor is arranged between the first impeller and the second impeller. Therefore a distance between these first and second impellers becomes necessarily long. Consequently if these impellers are connected via external piping, the piping structure becomes long and complicated. In addition, since there are many bent portions in the piping, flow of the fluid is disturbed and separation is likely to occur, so that pressure loss increases.

Moreover, the turbo compressor disclosed in Japanese Unexamined Patent Application, First Publication No. 2007-177695, is one where there is no drive motor between the two impellers, and the distance between the impellers can be shortened. However the structure has piping inside the housing. Therefore the curvature of the piping is small so that separation is likely to occur, and the pressure loss is increased. Moreover a space for arranging a diffuser to be provided around the impeller cannot be ensured sufficiently. As a result the pressure energy cannot be obtained efficiently, and improvement in performance of the compressor is difficult.

SUMMARY OF THE INVENTION

In view of the above situation, it is an object of the present invention to provide a two-stage turbo compressor having a piping structure optimized to decrease the pressure loss and improve the performance of the compressor, and a refrigerator provided with the turbo compressor.

In order to solve the above problems, the turbo compressor according to the present invention comprises:

a first compression stage having a first impeller and a first housing enclosing the first impeller, that draws in and compresses a fluid;

a second compression stage having a second impeller connected to the first compression stage via a rotation shaft, and a second housing enclosing the second impeller, that is arranged adjacent to the first compression stage with backsides thereof facing each other, and that further compresses the compressed fluid from the first compression stage;

a discharge port for compressed fluid in the first compression stage, and a suction port for the compressed fluid in the second compression stage formed in a same plane as the discharge port; and a U-shaped pipe that connects the discharge port and the suction port.

According to the turbo compressor having such a characteristic, the distance between the two impellers arranged back to back and adjacent to each other becomes short. Furthermore since the discharge port in the first compression stage and the suction port in the second compression stage are open in the same plane, the discharge port and the suction port can be connected externally by a U-shaped pipe having a shortest path length and a simple piping structure.

Consequently, a flow path can be provided with only one bend and a large curvature, and with the shortest path length. Therefore the pressure loss can be suppressed to a minimum, and since an external piping system is used, the space for arranging the diffuser within the housing can be ensured sufficiently.

Moreover, in the turbo compressor according to the present invention, a bent portion of the U-shaped pipe may have a semi-circular arc shape, with a line between the discharge port and the suction port designated as a diameter.

As a result, the fluid passing through the U-shaped pipe is guided from the discharge port to the suction port, while gradually changing direction under a constant curvature. Therefore a situation where separation occurs in the fluid, causing pressure loss can be suppressed.

Moreover in the turbo compressor according to the present invention, a gas injection pipe for injecting a gas additionally to the second compression stage may be connected to the U-shaped pipe.

As a result, the injected gas can be uniformly mixed with a main flow flowing in the U-shaped pipe, and guided to the impeller in the second compression stage.

Furthermore, in the turbo compressor according to the present invention, the gas injection pipe may be connected along a tangent of a bent portion of the U-shaped pipe.

As a result, the injected gas is merged along the main flow without disturbing the flow of the main flow. Therefore the gas can be injected without causing a pressure loss.

A refrigerator according to the present invention comprises: a condenser that cools and liquefies a compressed refrigerant; an evaporator that evaporates the liquefied refrigerant and absorbs heat of vaporization from an object to be cooled to thereby cool the object to be cooled; and a compressor that compresses the refrigerant evaporated by the evaporator and supplies the compressed refrigerant to the condenser, wherein any one of the above-described turbo compressors is provided as the compressor.

According to the refrigerator having such a characteristic, the same operation and effect as for the abovementioned turbo compressor can be demonstrated.

According to the turbo compressor and the refrigerator according to the present invention, by connecting the discharge port in the first compression stage and the suction port in the second compression stage with the U-shaped pipe having a simple structure, the fluid can be guided through the shortest distance, with a single bend and a large curvature. Therefore the pressure loss can be decreased.

Moreover, by using the external piping system, the space for arranging the diffuser can be ensured sufficiently, thereby enabling an improvement in the performance of the compressor.

DETAILED DESCRIPTION OF THE INVENTION

Figure 1:
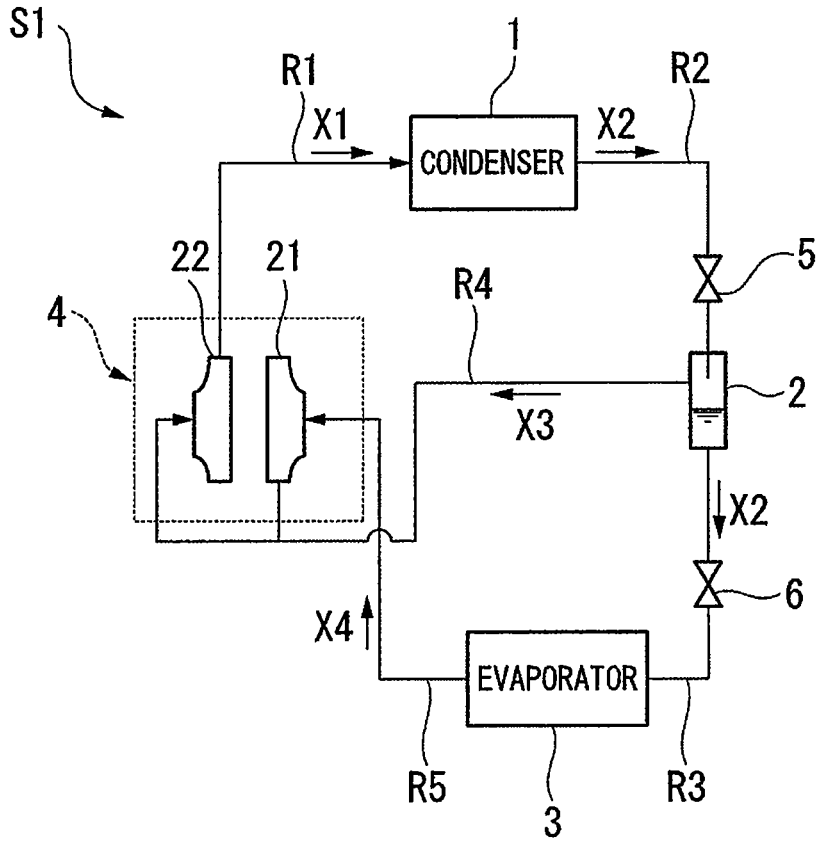
FIG. 1 is a block diagram showing a schematic configuration of a turbo refrigerator in an embodiment.

An embodiment of a turbo compressor and a turbo refrigerator according to the present invention will be described with reference to drawings. In the drawings, scaling of respective members is appropriately changed so that the respective members have recognizable sizes.

FIG. 1 is a block diagram showing a schematic configuration of a turbo refrigerator S (refrigerator) in the embodiment.

The turbo refrigerator S in this embodiment is installed in a building or factory for producing, for example, cooling water for air conditioning, and as shown in FIG. 1, is provided with a condenser 1, an economizer 2, an evaporator 3, and a turbo compressor 4.

The condenser 1 is supplied with a compressed refrigerant gas X1, which is a refrigerant (fluid) compressed in a gas phase, and cools and liquefies the refrigerant gas X1 to obtain a refrigerant liquid X2. As shown in FIG. 1, the condenser 1 is connected to the turbo compressor 4 via a flow path R1 through which the compressed refrigerant gas X1 flows, and is also connected to the economizer 2 via a flow path R2 through which the refrigerant liquid X2 flows. An expansion valve 5 for reducing the pressure of the refrigerant liquid X2 is installed in the flow path R2.

The economizer 2 temporarily stores the refrigerant liquid X2 that has been reduced in pressure by the expansion valve 5. The economizer 2 is connected to the evaporator 3 via a flow path R3 through which the refrigerant liquid X2 flows, and is also connected to the turbo compressor 4 via a flow path R4 through which a refrigerant gaseous phase component X3 produced in the economizer 2 flows. An expansion valve 6 for further reducing the pressure of the refrigerant liquid X2 is installed in the flow path R3. Moreover, the flow path R4 is connected to the turbo compressor 4 so as to supply the gaseous phase component X3 to a second compression stage 22 described later provided in the turbo compressor 4.

The evaporator 3 cools the object to be cooled such as water by evaporating the refrigerant liquid X2 and absorbing the heat of vaporization from the object to be cooled. The evaporator 3 is connected to the turbo compressor 4 via a flow path R5 through which a refrigerant gas X4 produced by evaporating the refrigerant liquid X2 flows. The flow path R5 is connected to a first compression stage 21 described later provided in the turbo compressor 4.

The turbo compressor 4 is for compressing the refrigerant gas X4 to obtain the compressed refrigerant gas X1. As described above, the turbo compressor 4 is connected to the condenser 1 via the flow path R1 through which the compressed refrigerant gas X1 flows, and is also connected to the evaporator 3 via the flow path R5 through which the refrigerant gas X4 flows.

In the turbo refrigerator S having such a configuration, the compressed refrigerant gas X1 supplied to the condenser 1 via the flow path R1 is liquefied and cooled by the condenser 1 to obtain the refrigerant liquid X2.

The refrigerant liquid X2 is reduced in pressure by the expansion valve 5 at the time of being supplied to the economizer 2 via the flow path R2, and is temporarily stored in the economizer 2 in a reduced pressure state. After this, the refrigerant liquid X2 is further reduced in pressure by the expansion valve 6 at the time of being supplied to the evaporator 3 via the flow path R3, and is then supplied to the evaporator 3 in the reduced pressure state.

Moreover the refrigerant liquid X2 supplied to the evaporator 3 is evaporated by the evaporator 3 to obtain the refrigerant gas X4, which is supplied to the turbo compressor 4 via the flow path R5.

The refrigerant gas X4 supplied to the turbo compressor 4 is compressed by the turbo compressor 4 to obtain the compressed refrigerant gas X1, which is again supplied to the condenser 1 via the flow path R1.

The refrigerant gaseous phase component X3 produced when the refrigerant liquid X2 is stored in the economizer 2, is supplied to the turbo compressor 4 via the flow path R4, and is compressed together with the refrigerant gas X4 and supplied to the condenser 1 as the compressed refrigerant gas X1 via the flow path R1.

Moreover in such a turbo refrigerator S, the heat of vaporization is absorbed from the object to be cooled when the refrigerant liquid X2 is evaporated by the evaporator 3, thereby cooling or freezing the object to be cooled.

Figure 2:
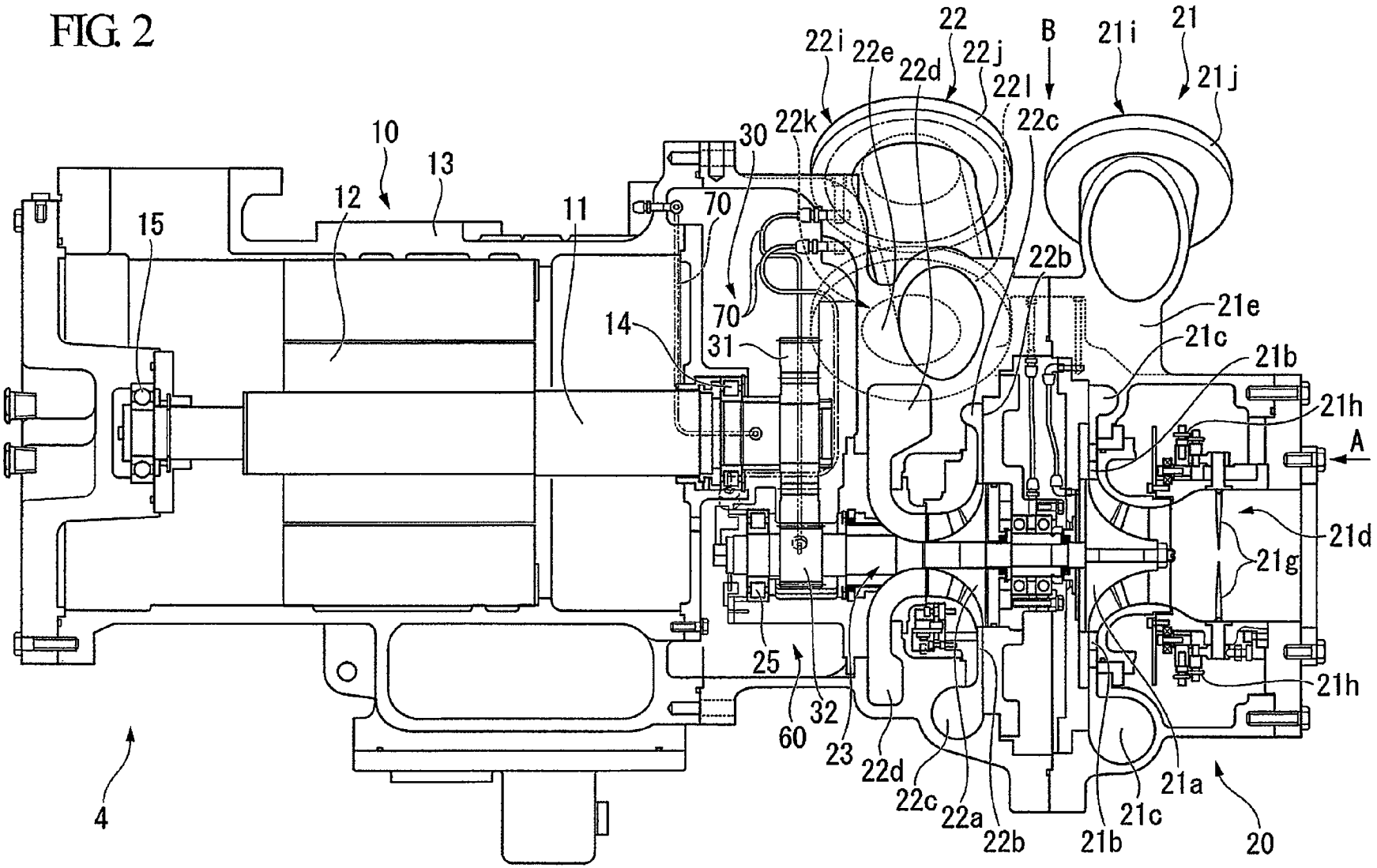
FIG. 2 is a vertical sectional view of a turbo compressor in the embodiment.
Figure 3:
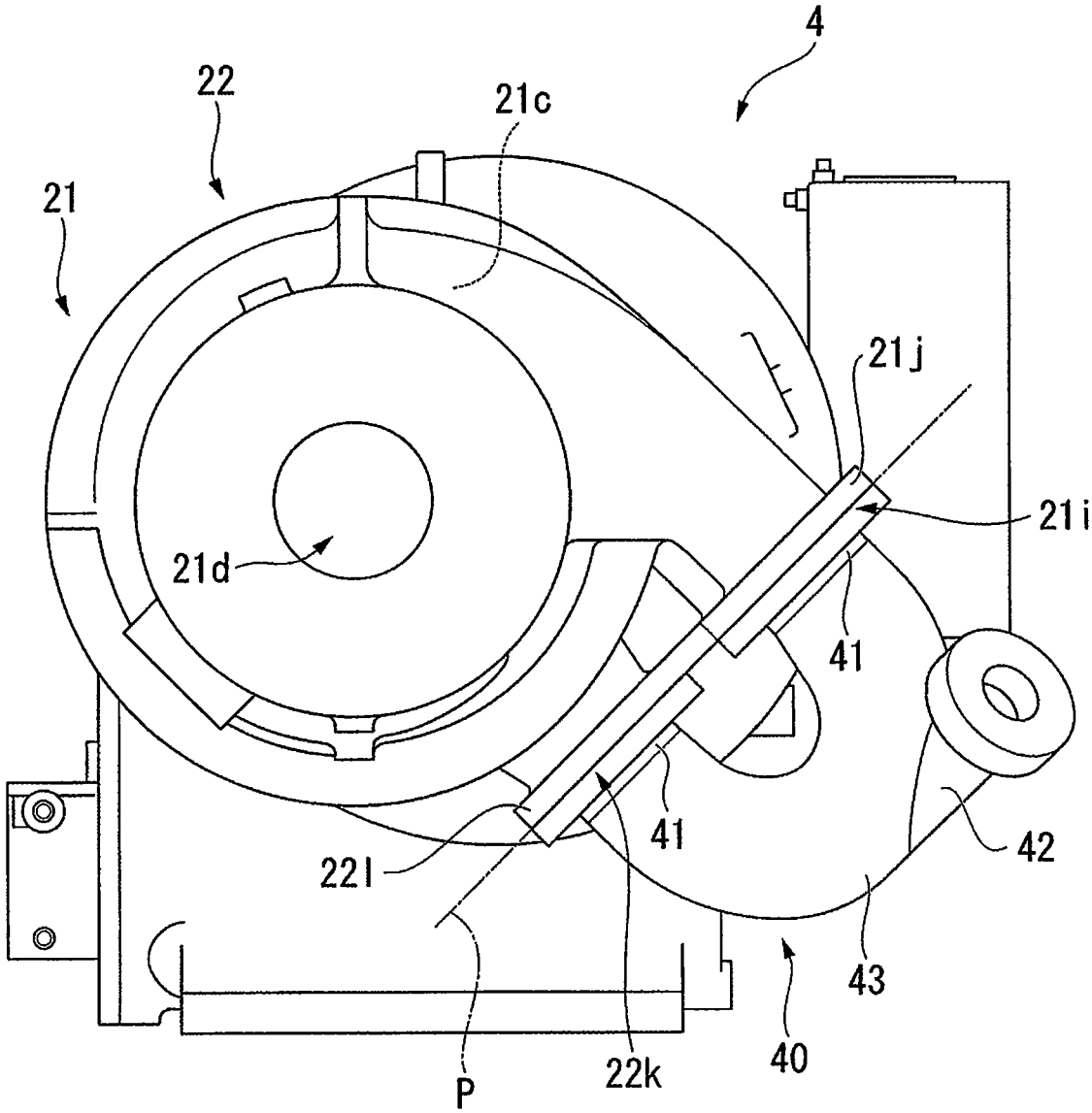
FIG. 3 is a view in the direction of arrow A in FIG. 2.
Figure 4:
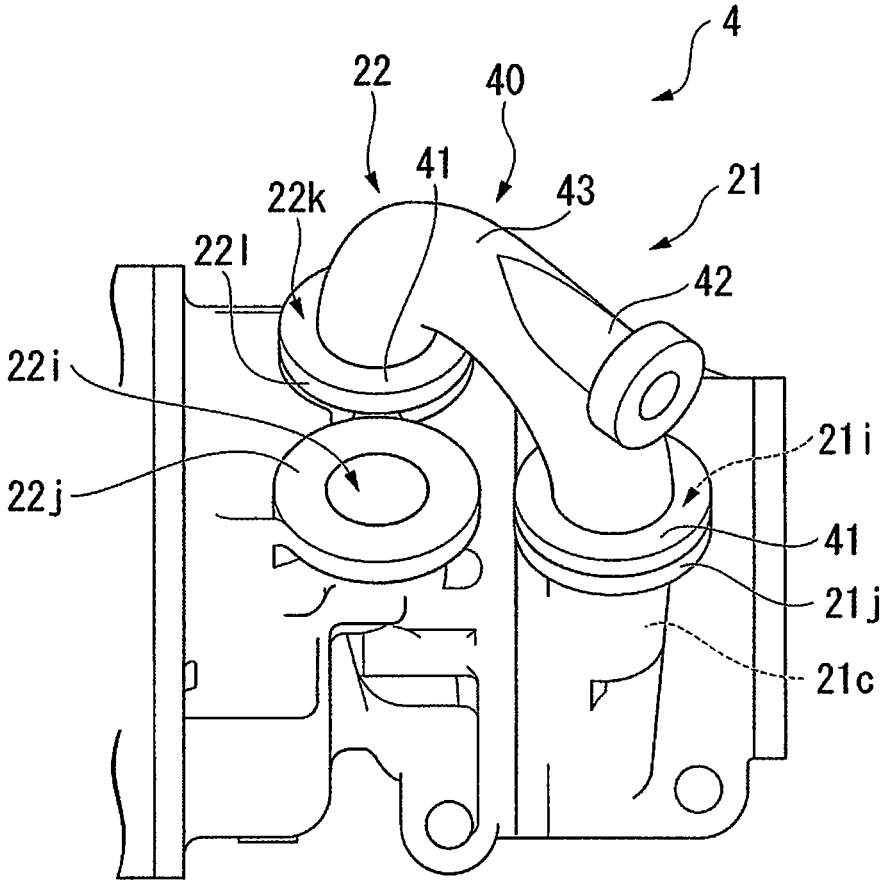
FIG. 4 is a view in the direction of arrow B in FIG. 2.

Next the turbo compressor 4, which is a characteristic part of the embodiment, will be explained in detail. FIG. 2 is a vertical sectional view of the turbo compressor 4, FIG. 3 is a view in the direction of arrow A in FIG. 2, and FIG. 4 is a view in the direction of arrow B in FIG. 2.

As shown in FIG. 2, the turbo compressor 4 in the embodiment is provided with a motor unit 10, a compressor unit 20, and a gear unit 30.

The motor unit 10 is provided with; a motor 12 having an output shaft 11, that becomes a drive source for driving the compressor unit 20, and a motor housing 13 that encloses the motor 12 and supports the motor 12.

The output shaft 11 of the motor 12 is rotatably supported by a first bearing 14 and a second bearing 15 fixed to the motor housing 13.

Moreover, the motor housing 13 is provided with an oil tank (omitted from the drawing) in which a lubricating oil supplied to the sliding parts of the turbo compressor 4 is collected and stored.

The compressor unit 20 is provided with a first compression stage 21 that draws in and compresses the refrigerant gas X4 (refer to FIG. 1), and a second compression stage 22 that further compresses the refrigerant gas X4 compressed in the first compression stage 21 and discharges it as the compressed refrigerant gas X1 (refer to FIG. 1).

The first compression stage 21 is provided with: a first impeller 21*a* (impeller) that imparts velocity energy to the refrigerant gas X4 supplied from a thrust direction, and discharges the gas in a radial direction; a first diffuser 21*b* that converts the velocity energy imparted to the refrigerant gas X4 by the first impeller 21*a* into pressure energy to thereby compress the refrigerant gas X4; a first scroll chamber 21*c* that leads out the refrigerant gas X4 compressed by the first diffuser 21*b*, to the outside of the first compression stage 21; and a first suction port 21*d* that draws in the refrigerant gas X4 and supplies the refrigerant gas X4 to the first impeller 21*a*.

Parts of the first diffuser 21*b*, the first scroll chamber 21*c*, and the first suction port 21*d* are formed by a first housing 21*e* that encloses the first impeller 21*a*.

The first impeller 21*a* is fixed on a rotation shaft 23 and is rotated by the rotation shaft 23 that transmits rotation power from the output shaft of the motor 12 and rotates about an axis O. The first diffuser 21*b* is annularly arranged on the circumference of the first impeller 21*a*.

The first scroll chamber 21*c* is formed so as to annularly enclose the first impeller 21*a* and the first diffuser 21*b*. It goes once around the circumference of the first impeller 21*a* and the first diffuser 21*b*, then extends to the outside of the first housing 21*e* and opens to form a first discharge port 21*i* as shown in FIG. 2 to FIG. 4. A first discharge flange 21*j* is provided on an opening edge of the first discharge port 21*i*.

Moreover a plurality of inlet guide vanes 21*g* for adjusting a suction capacity of the first compression stage 21 are installed in the first suction port 21*d* of the first compression stage 21.

The respective inlet guide vanes 21*g* are rotatable so that an apparent area seen from the flow direction of the refrigerant gas X4 can be changed by a drive mechanism 21*h* fixed to the first housing 21*e*.

The second compression stage 22 is provided with: a second impeller 22*a* that imparts velocity energy to the refrigerant gas X4 compressed in the first compression stage 21 and supplied from the thrust direction, and discharges the gas in a radial direction; a second diffuser 22*b* that converts the velocity energy imparted to the refrigerant gas X4 by the second impeller 22*a* (impeller) into pressure energy to thereby compress the refrigerant gas X4, and discharges it as compressed refrigerant gas X1; a second scroll chamber 22*c* that leads out the compressed refrigerant gas X1 discharged from the second diffuser 22*b*, to the outside of the second compression stage 22; and an introduction scroll chamber 22*d* that leads the refrigerant gas X4 compressed in the first compression stage 21, to the second impeller 22*a*.

Parts of the second diffuser 22*b*, the second scroll chamber 22*c*, and the introduction scroll chamber 22*d* are formed by a second housing 22*e* that encloses the second impeller 22*a*.

The second impeller 22*a* is fixed on the rotation shaft 23 so as to be arranged back to back with the first impeller 21*a*, and is rotated by the rotation shaft 23 that transmits rotation power from the output shaft 11 of the motor 12 and rotates about the axis O. The second diffuser 22*b* is annularly arranged on the circumference of the second impeller 22*a*.

The second scroll chamber 22*c* is formed so as to enclose the second impeller 22*a* and the second diffuser 22*b*. It goes once around the circumference of the second impeller 22*a* and the second diffuser 22*b*, then extends to the outside of the second housing 22*e*, and opens to form a second discharge port 22*i* as shown in FIG. 2 and FIG. 4. A second discharge flange 21*j* is provided on the opening edge of the first discharge port 21*i*.

The second discharge port 22*i* is connected to the flow path R1 for supplying the compressed refrigerant gas X1 to the condenser 1. However, the flow path R1 is omitted in FIG. 2 and FIG. 4.

Furthermore the introduction scroll chamber 22*d* of the second compression stage 22 is formed so as to annularly enclose the rotation shaft 23 at a position closer to the gear unit 30 side than the second scroll chamber 22*c*, and a part thereof extends to the outside of the second housing 22*e* and opens to form a second suction port 22*k* as shown in FIG. 2 to FIG. 4. A second suction flange 22*l* is provided on the opening edge of the second suction port 22*k*.

In the embodiment, the first discharge flange 21*j* of the first discharge port 21*i* and the second suction flange 22*l* of the second suction port 22*k* are formed so as to be positioned on the same plane P as shown in FIG. 3.

In the embodiment, an external piping system is adopted in which the first discharge port 21*i* in the first compression stage 21 and the second suction port 22*k* in the second compression stage 22 are connected to each other via a U-shaped pipe 40 provided separately from the first compression stage 21 and the second compression stage 22, and the refrigerant gas X4 compressed in the first compression stage 21 is supplied to the second compression stage 22 via the U-shaped pipe 40.

The U-shaped pipe 40 is provided with flanges 41 at the openings at the opposite ends thereof, which are airtightly and fluid-tightly connected to the first discharge flange 21*j* of the first discharge port 21*i* and the second suction flange 22*l* of the second suction port 22*k*, to thereby attach the U-shaped pipe 40 to the compressor unit 20.

A bent portion 43 of the U-shaped pipe 40 is formed in a semi-circular arc shape, with a line between the first discharge port 21*i* and the second suction port 22*k* designated as a diameter, and a gas injection pipe 42 is connected near the top of the U-shaped pipe 40 in a communicated state along the tangent of the bent portion 43. The gas injection pipe 42 is connected to the flow path R4, and the refrigerant gaseous phase component X3 produced in the economizer 2 is supplied to the second compression stage 22 via the gas injection pipe 42 and the U-shaped pipe 40.

Moreover, the rotation shaft 23 is rotatably supported by a third bearing 24 fixed to the second housing 22*e* of the second compression stage 22 in a space 50 between the first compression stage 21 and the second compression stage 22, and a fourth bearing 25 fixed to the second housing 22*e* on the motor unit 10 side.

The gear unit 30 is for transmitting the rotation power of the output shaft 11 of the motor 12 to the rotation shaft 23, and is housed in a space 60 formed by the motor housing 13 of the motor unit 10 and the second housing 22*e* of the compressor unit 20.

The gear unit 30 comprises a large-diameter gearwheel 31 fixed on the output shaft 11 of the motor 12, and a small-diameter gearwheel 32 fixed on the rotation shaft 23 and meshed with the large-diameter gearwheel 31, and transmits the rotation power of the output shaft 11 of the motor 12 to the rotation shaft 23 so as to increase the number of revolutions of the rotation shaft 23 with respect to the number of revolutions of the output shaft 11.

Furthermore the turbo compressor 4 is provided with a lubricating oil supply apparatus 70 that supplies a lubricating oil stored in an oil tank (omitted from the drawing) to between the bearings (first bearing 14, second bearing 15, third bearing 24, and fourth bearing 25), the impellers (first impeller 21*a* and second impeller 22*a*), and the housing (first housing 21*e* and second housing 22*e*), and to sliding portions such as the gear unit 30. In the drawing, only a part of the lubricating oil supply apparatus 70 is shown.

Furthermore the space 50 for arranging the third bearing 24, and the space 60 for housing the gear unit 30 are connected to each other via a through hole 80 formed in the second housing 22*e*. Moreover the space 60 and the oil tank are connected to each other. Therefore, the lubricating oil supplied to the spaces 50 and 60 and flowing down from the sliding portions, is collected in the oil tank.

Next is a description of the operation of the turbo compressor 4 in the embodiment configured in this manner.

At first, the lubricating oil supply apparatus 70 supplies the lubricating oil from the oil tank to the sliding portions of the turbo compressor 4, and then the motor 12 is driven. The rotation power of the output shaft 11 of the motor 12 is transmitted to the rotation shaft 23 via the gear unit 30. As a result, the first impeller 21*a* and the second impeller 22*a* of the compressor unit 20 are rotated.

When the first impeller 21*a* is rotated, the first suction port 21*d* of the first compression stage 21 becomes a negative pressure state, and the refrigerant gas X4 from the flow path R5 flows in to the first compression stage 21 via the suction port 21*d*.

The refrigerant gas X4 that has flowed in to the interior of the first compression stage 21 flows in to the first impeller 21*a* from the thrust direction, and is imparted with velocity energy by the first impeller 21*a* and discharged in the radial direction.

The refrigerant gas X4 discharged from the first impeller 21*a* is compressed by converting the velocity energy into pressure energy by the first diffuser 21*b*.

The refrigerant gas X4 discharged from the first diffuser 21*b* is led out to the first discharge port 21*i* positioned outside of the first compression stage 21 via the first scroll chamber 21*c*.

Then the refrigerant gaseous phase component X3 produced in the economizer 2 is injected into the refrigerant gas X4 by the gas injection pipe 42 during a process in which the refrigerant gas X4 that has been led in to the first discharge port 21*i* passes through inside the U-shaped pipe 40. After the refrigerant gas X4 is led in to the second suction port 22*k* in the second compression stage 22.

The refrigerant gas X4 supplied from the second suction port 22*k* to the second compression stage 22 flows in to the second impeller 22*a* in the thrust direction via the introduction scroll chamber 22*d*, and is discharged in the radial direction, with the velocity energy imparted by the second impeller 22*a*.

The refrigerant gas X4 discharged from the second impeller 22*a* is further compressed by converting the velocity energy into pressure energy by the second diffuser 22*b*, to obtain the compressed refrigerant gas X1.

The compressed refrigerant gas X1 discharged from the second diffuser 22*b* is led out to the second discharge port 22*i* positioned outside of the second compression stage 22 via the second scroll chamber 22*c*, and supplied to the condenser 1 via the flow path R1.

In the turbo compressor 4 in the above embodiment, because the first impeller 21*a* and the second impeller 22*a* are fixed back to back and there is no other mechanism such as the drive motor therebetween, the distance between the two impellers 21*a* and 22*a* can be shortened. Furthermore the first discharge port 21*i* of the first compression stage 21 and the second suction port 22*k* of the second compression stage 22 are open on the same plane. Consequently, the first discharge port 21*i* and the second suction port 22*k* can be connected outside of the compressor unit 20 by the U-shaped pipe 40 having the shortest path length and the simple piping structure.

In this manner, since the first discharge port 21*i* and the second suction port 22*k* can be connected to each other with only one bend and a large curvature by using the U-shaped pipe 40, separation of the fluid passing through inside the U-shaped pipe 40 can be suppressed to a minimum. Furthermore, since the first discharge port 21*i* and the second suction port 22*k* are connected with the shortest distance, the pressure loss can be considerably decreased.

Moreover by adopting the external piping system that connects using the U-shaped pipe 40 outside of the compressor unit 20, the space for arranging the first diffuser 21*b* and the second diffuser 22*b* inside the first housing 21*e* and the second housing 22*e* inside the compression unit 20 can be ensured sufficiently. Therefore the pressure energy can be obtained efficiently by the first and second diffusers 21*b* and 22*b*, and improvement in performance of the compressor can be achieved.

Moreover, in the turbo compressor 4 according to the embodiment, since the bent portion 43 of the U-shaped pipe 40 has a semi-circular arc shape, with the line between the first discharge port 21*i* and the second suction port 22*k* designated as a diameter, the fluid passing through inside is guided from first discharge port 21*i* to the second suction port 22*k*, while gradually changing direction under a constant curvature. Therefore, the occurrence of separation can be suppressed more efficiently, enabling the pressure loss to be further decreased.

Furthermore, since the gas injection pipe 42 for injecting the gas additionally to the second compression stage is connected along the tangent of the bent portion 43 of the U-shaped piping 40, the injected gas is merged along the main flow without disturbing the flow of the main flow. Therefore the gas can be injected without causing a pressure loss.

In the above, a preferred embodiment of the turbo compressor and the refrigerator according to the present invention has been explained with reference to the accompanying drawings. However, needless to say, the present invention is not limited to this embodiment. Various shapes and combinations of the respective components shown in the above embodiment are an example only, and can be variously changed based on design requirements, without departing from the gist of the present invention.

For example, a configuration provided with two compression stages (first compression stage 21 and second compression stage 22) has been explained in the embodiment, however, the configuration is not limited thereto, and one provided with three or more compression stages may be adopted.

Moreover in the embodiment, the turbo refrigerator has been described as one that is installed in a building or factory for producing cooling water for air conditioning.

However, the present invention is not limited thereto, and the turbo refrigerator can be applied to a cooler or refrigerator for domestic use or for business use, or to an air-conditioner for the domestic use.

Furthermore in the first embodiment, a configuration in which the first impeller 21*a* provided in the first compression stage 21 and the second impeller 22*a* provided in the second compression stage 22 are arranged back to back has been described.

However, the present invention is not limited thereto, and the configuration may be such that the back of the first impeller 21*a* provided in the first compression stage 21 and the back of the second impeller 22*a* provided in the second compression stage 22 are directed in the same direction.

Moreover in the first embodiment, a turbo compressor provided with the motor unit 10, the compressor unit 20, and the gear unit 30, respectively, has been described.

However, the present invention is not limited thereto, and for example, a configuration where the motor is arranged between the first compression stage and the second compression stage may be employed.

What is claimed is:

1. A turbo compressor comprising:

a first compression stage having a first impeller and a first housing enclosing said first impeller, that draws in and compresses a fluid to provide compressed fluid in said first compression stage;

a second compression stage having a second impeller connected to said first compression stage via a rotation shaft, and a second housing enclosing said second impeller, that is arranged adjacent to said first compression stage with backsides thereof facing each other, and that further compresses said compressed fluid provided from said first compression stage;

a discharge port provided on said first housing to discharge said compressed fluid from said first compression stage, a suction port provided on said second housing to suction said compressed fluid into said second compression stage, that is formed in a same plane as said discharge port; and a U-shaped pipe that connects said discharge port and said suction port, wherein the second compression stage includes an introduction scroll chamber connected to the suction port, which is formed so as to annularly enclose the rotation shaft, the introduction scroll chamber includes an inner surface located opposite said second impeller in said thrust direction, said inner surface curves from said radial direction to said thrust direction to reach said second impeller, the introduction scroll chamber configured to supply said compressed fluid to said second impeller via said inner surface, said compressed fluid supplied in said radial direction from said U-shaped pipe through said suction port, to said second impeller.

2. A turbo compressor according to claim 1, wherein a bent portion of said U-shaped pipe has a semi-circular arc shape, with a line between said discharge port and said suction port designated as a diameter.

3. A turbo compressor according to claim 1, wherein a gas injection pipe for injecting a gas additionally to said second compression stage is connected to said U-shaped pipe.

4. A turbo compressor according to claim 3, wherein said gas injection pipe is connected along a tangent of a bent portion of said U-shaped pipe.

5. A refrigerator comprising:

a condenser that cools and liquefies a compressed refrigerant;

an evaporator that evaporates said liquefied refrigerant and absorbs heat of vaporization from an object to be cooled to thereby cool said object to be cooled; and a compressor that compresses said refrigerant evaporated by said evaporator and supplies the compressed refrigerant to said condenser, wherein the turbo compressor according to claim 1 is provided as said compressor.

* * * * *